US006926755B2

(12) United States Patent
Shamblen et al.

(10) Patent No.: US 6,926,755 B2
(45) Date of Patent: Aug. 9, 2005

(54) METHOD FOR PREPARING ALUMINUM-BASE METALLIC ALLOY ARTICLES WITHOUT MELTING

(75) Inventors: Clifford Earl Shamblen, Cincinnati, OH (US); Andrew Philip Woodfield, Cincinnati, OH (US); Eric Allen Ott, Cincinnati, OH (US); Michael Francis Xavier Gigliotti, Glenville, NY (US)

(73) Assignee: General Electric Company, Schenectady, NY (US)

( * ) Notice: Subject to any disclaimer, the term of this patent is extended or adjusted under 35 U.S.C. 154(b) by 109 days.

(21) Appl. No.: 10/459,747

(22) Filed: Jun. 12, 2003

(65) Prior Publication Data

US 2004/0253136 A1 Dec. 16, 2004

(51) Int. Cl.[7] ..... B22F 3/00
(52) U.S. Cl. ..... 75/765; 420/590; 416/66
(58) Field of Search ..... 75/765; 420/590; 416/66

(56) References Cited

U.S. PATENT DOCUMENTS 3,909,247 A 9/1975 Paris et al.
4,373,947 A 2/1983 Buttner et al.
5,322,666 A 6/1994 Watwe
5,779,761 A 7/1998 Armstrong et al.
5,930,580 A 7/1999 Everett
5,958,106 A 9/1999 Armstrong et al.
6,737,017 B2 * 5/2004 Woodfield et al. ..... 419/30

FOREIGN PATENT DOCUMENTS

DE 1005942 B 4/1957
WO WO 99/64638 12/1999
WO WO 00/76698 A 12/2000

* cited by examiner

*Primary Examiner*—Melvyn Andrews
(74) *Attorney, Agent, or Firm*—McNees Wallace & Nurick LLC

(57) ABSTRACT

An article of aluminum base-metal alloyed with an alloying element is prepared by mixing a chemically reducible non-metallic base-metal precursor compound of the aluminum base-metal and a chemically reducible nonmetallic alloying-element precursor compound of an alloying element to form a precursor compound mixture. The alloying element may be, but is not necessarily, thermophysically melt incompatible with the aluminum base metal. The method further includes chemically reducing the precursor compound mixture to a metallic alloy, without melting the metallic alloy, and thereafter consolidating the metallic alloy to produce a consolidated metallic article, without melting the metallic alloy and without melting the consolidated metallic article.

22 Claims, 2 Drawing Sheets

METHOD FOR PREPARING ALUMINUM-BASE METALLIC ALLOY ARTICLES WITHOUT MELTING

This invention relates to the preparation of metallic-alloy articles, specifically aluminum-base alloy articles, without melting of the metallic alloy.

BACKGROUND OF THE INVENTION

Aluminum alloys are widely used in a number of commercial and industrial products due to their low density, moderate strength, and resulting high strength to weight ratio, and their environmental resistance. Aluminum alloys may also be used as a matrix for a composite material or article. Alloy utilization is typically limited to component applications with operating temperatures below about 300° F. Aluminum and its alloys are used extensively in the aircraft industry and are also used in other industries such as automotive. Aluminum alloy articles are fabricated by any number of techniques, as may be appropriate for the nature of the alloy and the article. The reduction of aluminum from aluminum-containing bauxite ore is accomplished predominantly by first purifying the ore and subsequently electrolytically reducing it in a cryolite bath by the Hall-Heroult Process. Other reduction methods may also be possible but are not currently in widespread commercial practice. Aluminum metal is produced which can be subsequently used to make aluminum alloys and articles. Some alloying elements and impurities such as iron, silicon, zinc, gallium, titanium, and vanadium may also be present as a result of ore quality and processing and these elements contribute to the final alloy content. Elements and combinations of elements may take many intermediate forms before being melted to form the final aluminum alloy. Alloying content in aluminum alloys may originate from ore reduction processes, virgin additions, or from reclamation of recycled material.

The metal is refined as necessary to remove or reduce the amounts of undesirable minor elements. The composition of the refined metal may also be modified by the addition of desirable alloying elements. These refining steps may be performed at the ore stage, during the initial melting process or during remelting operations. After an aluminum alloy of the desired composition is produced, it may be used in the as-cast form for some alloy compositions (i.e. cast alloys), it may be further worked to form the metal to the desired shape for other alloy compositions (i.e. wrought alloys), or it may be atomized to form fine powder and subsequently consolidated and, in some case further worked (i.e. powder metallurgy alloys), or may be solidified rapidly in a powder, ribbon, flake, spray-formed ingot, or other form and subsequently consolidated (i.e. rapidly solidified alloys). Powder alloys may be further modified via mechanically alloying methods. In any case, further processing such as heat treating, machining, surface coating, and the like may be employed.

Regardless of processing route, all of these forms involve melt processing and are, as a result, subject to restrictions imposed by such processes. The melting of aluminum materials may include multiple melt processes to cast the final ingot or article or to produce other intermediate product forms such as powder, ribbon, or flake. In multiple melt processes, intermediate cast electrodes are produced which serve as the input stock to the subsequent melting step. Typical melting processes include various crucible and open hearth melting vessels which can be heated using induction heating, gas or oil firing, electric resistance heating, or electrical radiation heating. Molten aluminum or aluminum alloy is further processed and refined in order to reduce residual hydrogen content, reduce trace element contaminant levels, and establish desired alloying element content. Refining processes may include hydrogen degassing, fluxing, and filtering. Degassing may be accomplished through use of a purge or injected gas which may include reactive and inert gas mixtures, through vacuum degassing, or through other techniques which promote formation and evolution of hydrogen gas bubbles from the molten aluminum alloy. During fluxing operations, inorganic salts can be added which supply anions for reaction with undesirable molten metal contaminants. The flux may also contain active ingredients intended to alloy with the molten metal. The flux layer or injected flux may also act to collect reaction products and contaminants and reduce volatization of high vapor pressure alloying elements and limit the formation of oxide films during melting. Other melt additives such as chlorides or fluorides (aluminum fluoride, for example) may also be used to reduce alkali metal impurities. Filtration of the molten alloy is also used in order to remove solid impurities and is typically accomplished using porous ceramic filters, metal screens, or fiberglass cloth filters.

Composition limitations may be imposed as a result of the melting process for aluminum alloys. Elements with high vapor pressures, significant reactivity, or limited solubility may be desirable due to their contributions to alloy strength, temperature capability, environmental resistance, formability and density. Alloying element content is limited significantly and/or is difficult to control as a result of the melting operations.

Irregularities may result from melting processes or as a result of subsequent forming operations. Melt-related irregularities include those related to segregation as well as those resulting from extrinsic contaminants. Melting of aluminum is subject to the formation of inclusions such as oxides and spinels of aluminum and/or magnesium for example, and highly stable compounds such as borides, carbides, nitrides, and intermetallics, which form from elements such as aluminum, titanium, vanadium, zirconium, manganese, and iron. Liquid phase inclusions such as magnesium chloride may also be problematic. These melt-related inclusions and other irregularities can significantly degrade the performance of cast alloys. Melt-related irregularities can also contribute to forging related irregularities such as cracking, etc. Some materials are also more difficult to form as a result of inheriting coarse cast structures, which can lead to additional forging-related irregularities.

Some aluminum alloys are also produced using powder metallurgy processes to enable production of higher alloying element compositions with resulting increases in alloy strength level. Other rapid solidification processes are also used in order to extend the solid solubility of various alloying element additions through very rapid, non-equilibrium solidification of finely divided material. The current powder metallurgy processes and other rapid solidification processes, however, require alloy material to first be melted and then atomized to produce powder. These powder metallurgy processes add great expense and can still result in extrinsic contamination from crucible ceramics and slag. In addition, powder metallurgy processes are also subject to issues related to gas entrapment in powder particles during the atomization process, which can lead to residual porosity in the resulting billet or component.

As a result, melting processes impose significant limitations on the resulting article. Incremental performance improvement resulting from processing modifications and incremental improvements in production cost reduction are still possible in a number of areas. However, the present inventors have recognized in the work leading to the present invention that in other instances the fabrication approach involving multiple melt steps imposes fundamental performance limitations that cannot be overcome at any reasonable cost. They have recognized a need for a departure from the conventional thinking in fabrication technology towards a meltless process, which will overcome many of these fundamental limitations. The present invention fulfils this need, and further provides related advantages.

BRIEF SUMMARY OF THE INVENTION

The present invention provides a method for preparing an article made of a conventional aluminum alloy or an alloy of aluminum with a thermophysically melt-incompatible alloying element or elements. The present approach circumvents problems, which cannot be avoided in melting practice or are circumvented only with great difficulty and expense. The present approach permits a homogeneous alloy to be prepared without subjecting the constituents to the circumstance, which leads to the incompatibility, specifically the melting process. Unintentional oxidation of the reactive metal and the alloying elements is also avoided. The present approach permits the preparation of articles with compositions that may not be otherwise readily prepared in commercial quantities. Master alloys are not used.

An article of aluminum base metal alloyed with an alloying element is prepared by mixing a chemically reducible nonmetallic base-metal precursor compound of the aluminum base metal and a chemically reducible nonmetallic alloying-element precursor compound of an alloying element to form a precursor compound mixture. The base metal, which is present in the alloy in an amount greater than any other element by atomic percent, is aluminum. The alloying element(s) may be thermophysically melt incompatible with the base metal, but both thermophysically melt incompatible and thermophysically melt compatible alloying elements may be present. The method further includes chemically reducing the precursor compound mixture to a metallic alloy, without melting the metallic alloy, and thereafter consolidating the metallic alloy to produce a consolidated metallic article, without melting the metallic alloy and without melting the consolidated metallic article.

The nonmetallic precursor compounds may be solid, liquid, or gaseous. The chemical reduction is preferably performed by solid-phase reduction, such as fused salt electrolysis of the precursor compounds in a finely divided solid form such as an oxide of the element; or by vapor-phase reduction, such as contacting vapor-phase halides of the base metal and the alloying element(s) with a liquid alkali metal or a liquid alkaline earth metal. The final article has more aluminum by atom percent than any other element.

In another embodiment, a method for preparing an aluminum-base article made of aluminum-base metal and alloyed with an alloying element comprises the steps of providing a chemically reducible nonmetallic base-metal precursor compound of the aluminum base metal, and providing a chemically reducible nonmetallic alloying-element precursor compound of an alloying element that is thermophysically melt incompatible with the aluminum base metal, and thereafter mixing the base-metal precursor compound and the alloying-element precursor compound to form a precursor compound mixture. The method further includes chemically reducing the precursor compound mixture to produce a metallic alloy, without melting the metallic alloy, and thereafter consolidating the metallic alloy to produce a consolidated metallic article, without melting the metallic alloy and without melting the consolidated metallic article. Other compatible features described herein may be used with this embodiment.

The alloying element may or may not be thermophysically melt incompatible. If it is thermophysically melt incompatible, the thermophysical melt incompatibility of the desired alloying element with the aluminum base metal may be any of several types. Some specific examples of thermophysical melt incompatibility for aluminum-base alloys follow. In the alloys, there may be one or more thermophysically melt incompatible elements, or one or more elements that are not thermophysically melt incompatible with the base metal.

One such thermophysical melt incompatibility occurs when the alloying element exhibits a partial or complete immiscibility with the aluminum base metal in the liquid phase. Examples of such alloying elements for aluminum-base binary alloys include certain proportions of bismuth, cadmium, indium, and lead.

Another such thermophysical melt incompatibility occurs when high-melting-point phases solidify prior to the solidification of the aluminum alloy. Examples of such alloying elements for aluminum-base binary alloys include certain proportions of arsenic, barium, beryllium, calcium, cerium, cobalt, chromium, erbium, iron, gadolinium, holmium, lanthanum, manganese, niobium, neodymium, nickel, palladium, platinum, antimony, selenium, silicon, strontium, tantalum, thorium, titanium, vanadium, tungsten, yttrium, ytterbium, zirconium, hafnium, molybdenum, rhenium, ruthenium, and/or samarium.

Another such thermophysical melt incompatibility occurs when there is limited or no solid solubility of the alloying element and there is formation of a eutectic, a eutectoid, a peritectic, or a peritectoid phase distribution upon solidification. Examples of such alloying elements for aluminum-base binary alloys include certain proportions of beryllium, bismuth, calcium, cadmium, cerium, cobalt, erbium, iron, gadolinium, holmium, indium, lanthanum, neodymium, nickel, lead, palladium, platinum, antimony, strontium, thallium, yttrium, ytterbium, and/or samarium. Similar reactions for other elements may also form undesirable phase distributions.

Another such thermophysical melt incompatibility occurs when the solid solubility limit of the alloying element may be exceeded, for example to achieve higher volume fractions of strengthening precipitates, and there is a eutectic phase decomposition upon solidification from the liquid phase. Examples of such alloying elements for aluminum-base binary alloys include certain proportions of copper, germanium, magnesium, manganese, and/or silicon.

Another such thermophysical melt incompatibility occurs when there is an attempt to manufacture alloys containing finely distributed phases, rather than being formed as agglomerates in the liquid prior to solidification due to the high melting point of the phase. Examples of such alloying elements for aluminum-base alloys include certain proportions of nitrogen, oxygen, and/or phosphorus.

Another such thermophysical melt incompatibility is in the vapor pressure, as where the alloying element has an evaporation rate of greater than about 10 times that of the base metal at a melt temperature, which is typically a temperature just above the liquidus temperature of the alloy. Examples of such alloying elements for aluminum-base alloys include lithium, lead, and/or silver.

Another such thermophysical melt incompatibility occurs when the melting point of the alloying element is too high or too low to be compatible with that of the aluminum base metal, as where the alloying element has a melting point different from (either greater than or less than) that of the aluminum base metal of more than about 200° C. Examples of such alloying elements for aluminum-base alloys include yttrium, rare earth elements, and/or gallium. Some of these elements may be furnished in master alloys whose melting points are closer to that of the aluminum base metal, but the master alloys are often expensive.

Another such thermophysical melt incompatibility occurs when the density of the alloying element is so different from that of the aluminum base metal that the alloying element physically separates in the melt, as where the alloying element has a density difference with the base metal of greater than about 0.5 gram per cubic centimeter. Examples of such alloying elements for aluminum-base alloys include rare earth elements, cobalt, nickel, tungsten, and/or niobium.

These and other types of thermophysical melt incompatibilities lead to difficulty or impossibility in forming acceptable alloys of the desired concentrations of these elements in a conventional melting practice, powder metallurgical processes, and rapid solidification processes. The present approach, in which the metals are not melted at all during production or processing, circumvents the thermophysical melt incompatibility to produce good quality, homogeneous alloys with improved properties, and avoids formation of undesirable phases or undesirable distributions of phases resulting in poor properties.

Some additional processing steps may be included in the present approach. In some cases, such as solid-phase reduction, it is preferred that the solid precursor compound mixture be compacted, after the step of mixing and before the step of chemically reducing. The result is a compacted mass which, when chemically reduced, produces a spongy metallic material. After the chemical reduction step, the metallic alloy is consolidated to produce a consolidated metallic article, without melting the metallic alloy and without melting the consolidated metallic article. This consolidation may be performed with any physical form of the metallic alloy produced by the chemical reduction, but the approach is particularly advantageously applied to consolidating of the pre-compacted sponge. Consolidation is preferably performed by hot pressing or hot isostatic pressing, or extrusion, but without melting in each case. Solid state diffusion of the alloying elements may also be used to achieve the consolidation.

The consolidated metallic article may be used in the as-consolidated form. In appropriate circumstances, it may be formed to other shapes using known forming techniques such as rolling, forging, extrusion, and the like. It may also be post-processed by known techniques such as machining, heat treating, surface coating, and the like.

The present approach may be used to fabricate articles from the precursor compounds, entirely without melting. As a result, the characteristics of the alloying elements which lead to thermophysical melt incompatibility, such as excessive evaporation due to high vapor pressure, overly high or low melting point, overly high or low density, excessive chemical reactivity, strong segregation tendencies, and the presence of a miscibility gap, may still be present but cannot lead to inhomogeneities or irregularities in the final metallic alloy. The present approach thus produces the desired alloy composition of good quality, but without interference from these thermophysical melt incompatibilities that otherwise would prevent the formation of an acceptable alloy and alloy microstructure morphology.

The present approach differs from prior approaches in that the metal is not melted on a gross scale. Melting and its associated processing such as casting are expensive and also produce some undesirable microstructures that either are unavoidable or can be altered only with additional expensive processing steps. The present approach reduces cost and avoids structures and irregularities associated with melting and casting, to improve mechanical properties of the final metallic article. Where the alloying elements are thermophysically melt incompatible with the aluminum base metal or with each other, novel alloys may be prepared that cannot be prepared by approaches that include melting. It also results in some cases in an improved ability to fabricate specialized shapes and forms more readily, and to inspect those articles more readily.

Several types of solid-state consolidation are known in the art. Examples include hot isostatic pressing, and pressing plus sintering, canning and extrusion, and forging. However, in all known instances these solid-state processing techniques start with metallic material, which has been previously melted. The present approach starts with nonmetallic precursor compounds, reduces these precursor compounds to the metallic material, and consolidates the metallic material. There is no melting of the metallic form.

As a result of eliminating the melting process, this technique avoids a cast structure with its associated irregularities such as elemental segregation on a nonequilibrium microscopic and macroscopic level, a cast microstructure with a range of larger-than-desirable grain sizes and morphologies that must be homogenized in some manner for many applications, gas entrapment, contamination, elevated hydrogen and hydrogen pores and bubbles, oxides (of aluminum and magnesium, for example), spinels (Al—Mg—O, for example), borides ($TiB_2$, $VB_2$, and $ZrB_2$, for example), carbides ($Al_3C$ and TiC, for example), nitrides (AlN, for example), refractory exogenous inclusions (oxides and carbides of iron, silicon, and aluminum, for example), and inclusions resulting from filtering methods. The present approach produces a uniform, fine-grained, homogeneous, pore-free, gas-pore-free, and low-contamination final product.

The fine-grain, segregation-free structure of the metallic material provides an excellent starting point for subsequent consolidation and metalworking procedures such as forging, hot isostatic pressing, rolling and extrusion. Conventional cast starting material must be worked to modify and eliminate the as-cast structure, and such working is not necessary with the present approach.

Another important benefit of the present approach is improved inspectability as compared with cast-and-wrought product. Large metallic articles used in fracture-critical applications are inspected multiple times during and at the conclusion of the fabrication processing. Cast-and-wrought product made of metals used in critical applications may exhibit a high noise level in ultrasonic inspection due to the coarse-grain structure produced when the alloy is solidified as a casting or due to solidification structures and segregation inherited from the original casting or forged products. The coarse-grain structure and its associated noise level limit the ability to inspect for small irregularities. The articles produced by the present approach have a fine-grained microstructure, which does not adversely affect the inspectability during ultrasonic inspection.

The present approach also offers important benefits when used to make alloys of aluminum base metal with conventional alloying elements that are not thermophysically incompatible with the base metal. Conventional melting-and-casting technology of commercial-scale heats of alloys, starting from ores of the metals, inevitably results in levels of impurity elements in the alloys. In some cases, the presence of the impurity elements produces highly undesirable effects on the properties of the alloys in service. In some cases the adverse effects of minor amounts of these elements has become evident only as the applications of the alloys become ever-more demanding. The present approach reduces, and in some cases eliminates entirely, the presence of such minor levels of impurity elements, due to the low-impurity nature of the starting materials and the low processing temperatures that are used, which does not cause the impurity elements to migrate into the alloy. As a result, the strength, fatigue properties, and oxidation/sulfidization/corrosion resistance of the alloys are improved, as compared with the nominally same alloys produced by conventional techniques.

The present approach thus allows the production of new alloys that cannot be made with the present melting-and-casting technology because of thermophysical melt incompatibility. It also allows the production of existing alloy compositions that can be made by melting-and-casting technology, but with improved properties and better quality than possible with the existing melting-and-casting technology.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
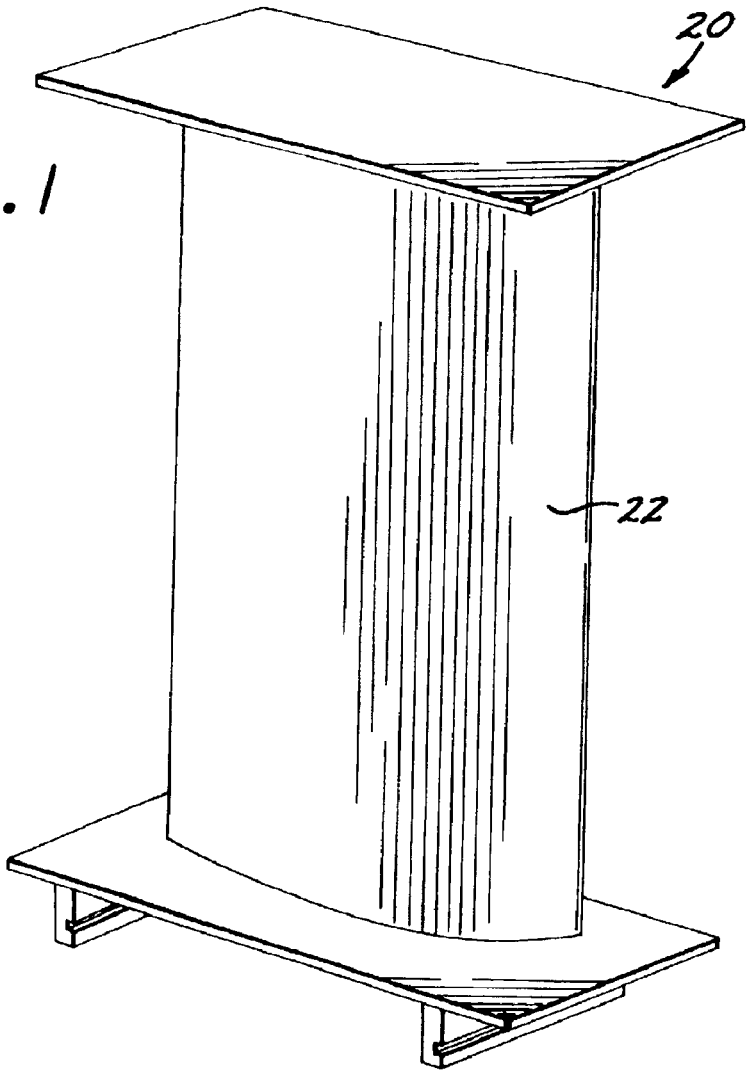
FIG. 1 is a perspective view of a metallic article prepared according to the present approach.

The present approach may be used to make a wide variety of metallic articles 20, such as a strut 22 of FIG. 1. The strut 22 is only one example of the types of articles 20 that may be fabricated by the present approach. Some other examples include other gas turbine parts such as fan and compressor disks, fan blades, booster blades and vanes, and fan frames and cases, automobile parts, biomedical articles, and structural members such as airframe parts. There is no known limitation on the types of articles that may be made by this approach.

Figure 2:
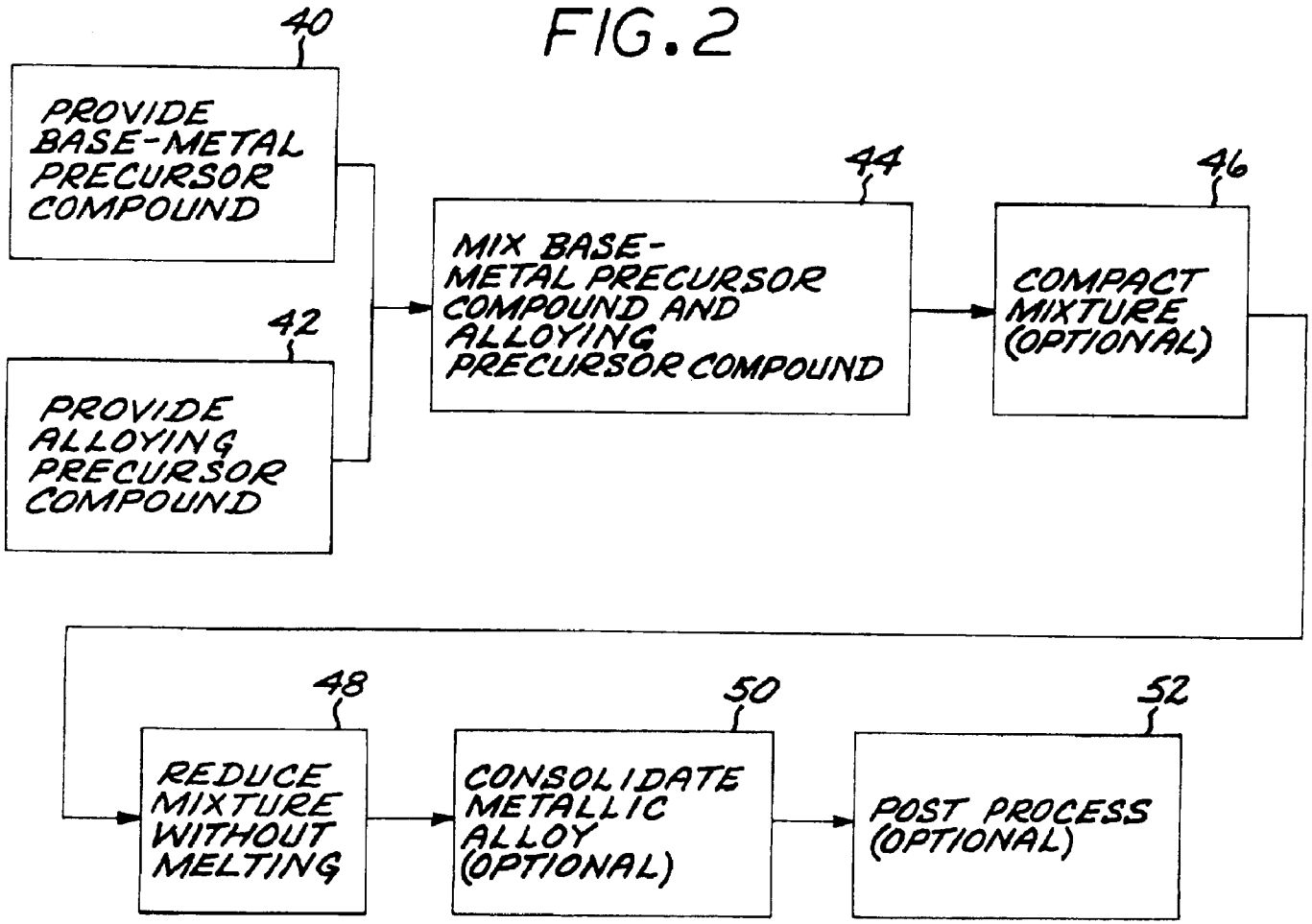
FIG. 2 is a block flow diagram of an approach for practicing the invention.

FIG. 2 illustrates a preferred approach for preparing an article of an aluminum base metal and an alloying element. The method comprises providing a chemically reducible nonmetallic base-metal precursor compound, step 40, and providing a chemically reducible nonmetallic alloying-element precursor compound of an alloying element, step 42. The alloying element may be thermophysically melt-incompatible or thermophysically melt compatible. "Nonmetallic precursor compounds" are nonmetallic compounds of the metals that eventually constitute the metallic article 20. Any operable nonmetallic precursor compounds may be used. Reducible oxides of the metals are the preferred nonmetallic precursor compounds in solid-phase reduction, but other types of nonmetallic compounds such as sulfides, carbides, halides, and nitrides are also operable. Reducible halides of the metals are the preferred nonmetallic precursor compounds in vapor-phase reduction. The base metal is a metal that is present in a greater atomic percentage than any other element in the alloy. The base-metal precursor compound is present in an amount such that, after the chemical reduction to be described subsequently, there is more of the base metal present, measured in atomic percent, in the metallic alloy than any other element. The base metal of interest is aluminum. The preferred base-metal precursor compound is aluminum oxide for solid-phase reduction or aluminum chloride for vapor-phase reduction. The alloying element may be any element that is available in the chemically reducible form of the precursor compound. A few illustrative examples are zinc, magnesium, and copper.

The nonmetallic precursor compounds are selected to provide the necessary metals in the final metallic article, and are mixed together in the proper proportions to yield the necessary proportions of these metals in the metallic article. An example is an alloy having a composition, in weight percent, of 12 percent Zn, 3 percent Mg, 1 percent Cu, 0.25 percent Mn, 0.2 percent Cr, 0.2 percent Zr, balance Al and possibly minor amounts of impurity elements. To prepare such an alloy by the present approach, the nonmetallic precursor compounds would together supply these elements in the weight ratio of 12 parts Zn:3 parts Mg:1 part Cu:0.25 part Mn:0.2 part Cr:0.2 part Zr:83.35 parts Al.

The base-metal precursor compound and the alloying-element precursor compound are preferably finely divided solids or gaseous in form to ensure that they are chemically reacted in the subsequent step. The finely divided base-metal precursor compound and alloying precursor compound may be, for example, powders, granules, flakes, or the like.

The benefits of the present approach may be particularly realized in conjunction with thermophysically melt incompatible alloys. "Thermophysical melt incompatibility" and related terms refer to the basic concept that any identified thermophysical property of an alloying element is sufficiently different from that of the base metal (or from that of other alloying elements) to cause detrimental effects in the melted final product. These detrimental effects include phenomena such as chemical inhomogeneity (detrimental micro-segregation, macro-segregation, and gross segregation from vaporization, density separation, or immiscibility), inclusions of the alloying elements such as high-density inclusions, and the like. Thermophysical properties are intrinsic to the elements, and combinations of the elements, which form alloys, and are typically envisioned using equilibrium phase diagrams, vapor pressure versus temperature curves, and similar approaches. Although alloy systems may only approach predicted equilibrium, these envisioning data provide information sufficient to recognize and predict the cause of the detrimental effects as thermophysical melt incompatibilities. However, the ability to recognize and predict these detrimental effects as a result of the thermophysical melt incompatibility does not provide a melting route alternative, which circumvents the incompatibility. The present approach provides a technique to minimize and desirably avoid the detrimental effects by the elimination of melting in the preparation and processing of the alloy.

Thus, "thermophysical melt incompatible" and related terms mean that the alloying element or elements in the alloy to be produced do not form a well mixed, homogeneous alloy with the base metal in a production melting operation in a stable, controllable fashion. In some instances, a thermophysically melt incompatible alloying element cannot be readily incorporated into the alloy at any compositional level, and in other instances the alloying element can be incorporated at some levels but not at other levels. For example, some elements do not behave in a thermophysically melt incompatible manner when introduced at low levels, and homogeneous alloys of such alloying additions may be prepared. However, if there is an attempt to introduce greater levels of such elements, they tend to segregate strongly in the melt and/or during subsequent solidification, and thus behave in a thermophysically melt incompatible manner so that homogeneous alloys can only be prepared with great difficulty or not at all. Examples of such elements include zinc and silicon.

The thermophysical melt incompatibility of the alloying element with aluminum base metal may be any of several types, and some examples follow.

One such thermophysical melt incompatibility occurs when the alloying element exhibits a partial or complete immiscibility with the aluminum base metal in the liquid phase. Examples of such alloying elements for aluminum-base binary alloys include certain proportions of bismuth, cadmium, indium, and/or lead.

Another such thermophysical melt incompatibility occurs when high-melting-point phases solidify prior to the solidification of the aluminum alloy. Examples of such alloying elements for aluminum-base binary alloys include certain proportions of arsenic, barium, beryllium, calcium, cerium, cobalt, chromium, erbium, iron, gadolinium, holmium, lanthanum, manganese, niobium, neodymium, nickel, palladium, platinum, antimony, selenium, silicon, strontium, tantalum, thorium, titanium, vanadium, tungsten, yttrium, ytterbium, zirconium, hafnium, molybdenum, rhenium, ruthenium, and/or samarium.

Another such thermophysical melt incompatibility occurs when there is limited or no solid solubility of the alloying element and there is formation of a eutectic or other reactions such as a eutectoid, a peritectic, or a peritectoid phase distribution upon solidification. Examples of such alloying elements for aluminum-base binary alloys include certain proportions of beryllium, bismuth, calcium, cadmium, cerium, cobalt, erbium, iron, gadolinium, holmium, indium, lanthanum, neodymium, nickel, lead, palladium, platinum, antimony, strontium, thallium, yttrium, ytterbium, and/or samarium.

Another such thermophysical melt incompatibility occurs when the solid solubility limit of the alloying element must be exceeded and there is a eutectic phase decomposition upon solidification from the liquid phase or other reactions. Examples of such alloying elements for aluminum-base binary alloys include certain proportions of copper, germanium, magnesium, manganese, zinc, and/or silicon.

Another such thermophysical melt incompatibility occurs when there is an attempt to manufacture alloys containing finely distributed phases, rather than being inherited as agglomerates from the melt due to the high melting point of the phases. Examples of such alloying elements for aluminum-base binary alloys include certain proportions of nitrogen, oxygen, and phosphorus.

Another such thermophysical melt incompatibility is in the vapor pressure, as where the alloying element has an evaporation rate of greater than about 10 times that of the base metal at a melt temperature, which is preferably a temperature just above the liquidus temperature of the alloy. Examples of such alloying elements for aluminum-base alloys include lithium, lead, and/or silver.

Another such thermophysical melt incompatibility occurs when the melting point of the alloying element is too high or too low to be compatible with that of the aluminum base metal, as where the alloying element has a melting point different from (either greater than or less than) that of the aluminum base metal of more than about 200° C. Examples of such alloying elements for aluminum-base alloys include yttrium, rare earth elements, and/or gallium. Some of these elements may be furnished in master alloys whose melting points are closer to that of the aluminum base metal, but the master alloys are often expensive.

Another such thermophysical melt incompatibility occurs when the density of the alloying element is so different from that of the aluminum base metal that the alloying element physically separates in the melt, as where the alloying element has a density difference with the base metal of greater than about 0.5 gram per cubic centimeter. Examples of such alloying elements for aluminum-base alloys include rare earth elements, cobalt, nickel, tungsten, and/or niobium.

These and other types of thermophysical melt incompatibilities lead to difficulty or impossibility in forming acceptable alloys of these elements in conventional production melting. Their adverse effects are avoided in the present melt-less approach.

The base-metal precursor compound and the alloying precursor compound are mixed to form a uniform, homogeneous precursor compound mixture, step 44. The mixing is performed by conventional procedures used to mix powders in other applications, for solid-phase reduction, or by the mixing of the vapors, for vapor-phase reduction.

Optionally, for solid-phase reduction of solid precursor compound powders the precursor compound mixture may be compacted to make a preform, step 46. This compaction is conducted by cold or hot pressing of the finely divided precursor compounds, but not at such a high temperature that there is any melting of the precursor compounds. The compacted shape may be sintered in the solid state to temporarily bind the particles together. The compacting desirably forms a shape similar to, but larger in dimensions than, the shape of the final article or intermediate mill-product form.

The mixture of nonmetallic precursor compounds is thereafter chemically reduced by any operable technique to produce an metallic material, without melting the metallic material, step 48. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperatures of the alloy that forms from the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a low level. The chlorides and mixtures of chlorides of barium, calcium, cesium, lithium, strontium, and yttrium are preferred. The chemical reduction may be carried to completion, so that the nonmetallic precursor compounds are completely reduced. Not carrying the process to completion is a method to control the oxygen content of the metal produced. For example, oxygen may be provided for the formation of oxide dispersions.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, aluminum chloride and the chlorides of the alloying elements are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy, which forms from the reduction process. The approach is described more fully in U.S. Pat. Nos. 5,779,761 and 5,958,106, whose disclosures are incorporated by reference.

Figure 3:
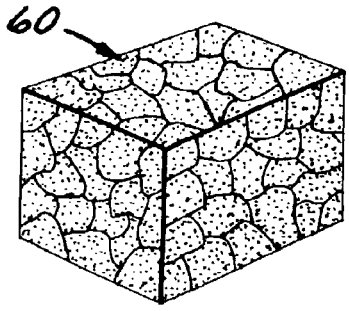
FIG. 3 is a perspective view of a spongy mass of the metallic material.

The physical form of the metallic material at the completion of step 48 depends upon the physical form of the mixture of nonmetallic precursor compounds at the beginning of step 48. If the mixture of nonmetallic precursor compounds is free-flowing, finely divided particles, powders, granules, pieces, or the like, the metallic material is also in the same form, except that it is smaller in size and typically somewhat porous. If the mixture of nonmetallic precursor compounds is a compressed mass of the finely divided particles, powders, granules, pieces, or the like, then the final physical form of the metallic material is typically in the form of a somewhat porous metallic sponge 60, as shown in FIG. 3. The external dimensions of the metallic sponge are smaller than those of the compressed mass of the nonmetallic precursor compound due to the removal of the oxygen and/or other combined elements in the reduction step 48. If the mixture of nonmetallic precursor compounds is a vapor, then the final physical form of the metallic material is typically fine powder that may be further processed.

The chemical composition of the metallic alloy is determined by the types and amounts of the metals in the mixture of nonmetallic precursor compounds furnished in steps 40 and 42. The relative proportions of the metallic elements are determined by their respective ratios in the mixture of step 44 (not by the respective ratios of the precursor compounds, but the respective ratios of the metallic element). In a case of interest, the metallic alloy has more aluminum in atomic percent than any other element, producing an aluminum-base metallic alloy.

Some constituents, termed "other additive constituents", may be difficult to introduce into the aluminum alloy. For example, suitable nonmetallic precursor compounds of the constituents may not be available, or the available nonmetallic precursor compounds of the other additive constituents may not be readily chemically reducible in a manner or at a temperature consistent with the chemical reduction of the other nonmetallic precursor compounds. It may be necessary that such other additive constituents ultimately be present as elements in solid solution in the aluminum alloy, as compounds formed by reaction with other constituents of the aluminum alloy, or as already-reacted, substantially inert compounds dispersed through the aluminum alloy. These other additive constituents or precursors thereof may be introduced from the gas, liquid, or solid phase, as may be appropriate, using one of the four approaches subsequently described or other operable approaches.

In a first approach, the other additive constituents are furnished as elements or compounds and are mixed with the precursor compounds prior to or concurrently with the step of chemically reducing. The mixture of precursor compounds and other additive constituents is subjected to the chemical reduction treatment of step 42, but only the precursor compounds are actually reduced and the other additive constituents are not reduced.

In a second approach, the other additive constituents in the form of solid particles are furnished but are not subjected to the chemical reduction treatment. Instead, they are mixed with the initial metallic material that results from the chemical reduction step, but after the step of chemically reducing 42 is complete. This approach is particularly effective when the step of chemically reducing is performed on a flowing powder of the precursor compounds, but it also may be performed on a pre-compacted mass of the precursor compounds, resulting in a spongy mass of the initial metallic material. The other additive constituents are adhered to the surface of the powder or to the surface of, and into the porosity of, the spongy mass.

In a third approach, the precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, from the gaseous phase. In one technique, a gaseous precursor or elemental form (e.g., methane or nitrogen gas) is flowed over surface of particle or sponge to deposit the element onto the surface from the gas.

A fourth approach is similar to the third approach, except that the other additive constituent is deposited from a liquid rather than from a gas. The precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, by deposition from the liquid. In one technique, the particulate or sponge is dipped into a liquid solution of a precursor compound of the other additive constituent to coat the surfaces of the particles or the sponge. The precursor compound of the other additive constituent is second chemically reacted to leave the other additive constituent at the surfaces of the particles or at the surfaces of the sponge. In an example, cerium may be introduced into the aluminum alloy by coating the surfaces of the reduced particles or sponge (produced from the precursor compounds) with cerium chloride. The coated particles are, or the sponge is, thereafter heated and/or exposed to vacuum to drive off the chlorine, leaving cerium at the surfaces of the particles or sponge.

The metallic alloy is in a form that is not structurally useful for most applications. Accordingly and preferably, the metallic alloy is thereafter consolidated to produce a consolidated metallic article, without melting the metallic alloy and without melting the consolidated metallic article, step 50. The consolidation removes porosity from the metallic alloy, desirably increasing its relative density to or near 100 percent. Any operable type of consolidation may be used. Preferably, the consolidation 50 is performed by hot isostatic pressing the metallic alloy under appropriate conditions of temperature and pressure, but at a temperature less than the melting points of the metallic alloy and the consolidated metallic article (which melting points are typically the same or very close together). Pressing, solid-state sintering, and canned extrusion may also be used, particularly where the metallic alloy is in the form of a powder. The consolidation reduces the external dimensions of the mass of metallic alloy, but such a reduction in dimensions are predictable with experience for particular compositions. The consolidation processing 50 may also be used to achieve further alloying of the metallic article or to produce a desirable oxygen dispersion to strengthen the material. For example, container can used in hot isostatic pressing may not be evacuated so that there is a residual oxygen content. Upon heating for the hot isostatic pressing, the residual oxygen diffuses into and alloys with the metallic alloy.

The consolidated metallic article, such as that shown in FIG. 1, may be used in its as-consolidated form. Instead, in appropriate cases the consolidated metallic article may optionally be post processed, step 52. The post processing may include forming by any operable metallic forming process, as by forging, extrusion, rolling, and the like. Some metallic compositions are amenable to such forming operations, and others are not. However, there would be an improvement in form ability even for those compositions deemed non-formable for melt production methods because of the finer microstructures achieved by the meltless approach. The consolidated metallic article may also or instead be optionally post-processed by other conventional metal processing techniques in step 52. Such post-processing may include, for example, joining, heat treating, surface coating, machining, and the like.

The metallic material is never heated above its melting point. Additionally, it may be maintained below specific temperatures that are themselves below the melting point and are dictated by solid-state phase transitions and chemical reactions in the alloys.

The microstructural type, morphology, and scale of the article are determined by the starting materials and the processing. The grains of the articles produced by the present approach generally correspond to the morphology and size of the powder particles of the starting materials, when the solid-phase reduction technique is used. In the present approach, the metal is never melted and cooled from the melt, so that the coarse grain structure associated with the solidified structure never occurs. In conventional melt-based practice, subsequent metalworking processes are designed to break up and reduce the coarse grain structure and segregation associated with solidification. Such processing is not required in the present approach.

The present approach processes the mixture of nonmetallic precursor compounds to a finished metallic form without the metal of the finished metallic form ever being heated above its melting point. Consequently, the process avoids the costs associated with melting operations. The microstructures associated with melting, typically large-grained structures and casting irregularities, are not found. Without such irregularities, the articles may be made more reliable. The greater confidence in the irregularity-free state of the article, achieved with the finer grain size, increased volume of fine strengthening phases, and better inspectability discussed above, also leads to a reduction in the extra material that must otherwise be present. New properties may be achieved because novel alloys incorporating the thermophysically melt incompatible elements may be prepared.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an article of aluminum base metal alloyed with an alloying element, comprising the steps of providing a chemically reducible nonmetallic base-metal precursor compound of the aluminum base metal;

providing a chemically reducible nonmetallic alloying-element precursor compound of an alloying element, wherein the step of providing the chemically reducible nonmetallic alloying-element precursor compound includes the step of providing the alloying-element precursor compound of the alloying element, wherein the alloying element is thermophysically melt incompatible with the aluminum base metal; thereafter mixing the base-metal precursor compound and the alloying-element precursor compound to form a precursor compound mixture; thereafter chemically reducing the precursor compound mixture to a metallic alloy, without melting the metallic alloy; and thereafter consolidating the metallic alloy to produce a consolidated metallic article, without melting the metallic alloy and without melting the consolidated metallic article.

2. The method of claim 1, wherein the step of providing the chemically reducible nonmetallic base-metal precursor compound includes the step of providing the chemically reducible nonmetallic base-metal precursor compound in a finely divided solid form, and wherein the step of providing the chemically reducible nonmetallic alloying-element precursor compound includes the step of providing the chemically reducible nonmetallic alloying-element precursor compound in a finely divided solid form.

3. The method of claim 1, wherein the step of providing the chemically reducible nonmetallic base-metal precursor compound includes the step of providing the chemically reducible nonmetallic base-metal precursor compound in a gaseous form, and wherein the step of providing the chemically reducible nonmetallic alloying-element precursor compound includes the step of providing a chemically reducible nonmetallic alloying-element precursor compound in a gaseous form.

4. The method of claim 1, wherein the step of providing a chemically reducible nonmetallic base-metal precursor compound includes the step of providing a chemically reducible base-metal precursor compound selected from the group consisting of a base-metal oxide and a base-metal halide.

5. The method of claim 1, wherein the step of providing the chemically reducible nonmetallic alloying-element pre cursor compound of the alloying element includes the step of providing a chemically reducible alloying-element oxide.

6. The method of claim 1, wherein the step of chemically reducing includes the step of chemically reducing the precursor compound mixture by solid-phase reduction.

7. The method of claim 1, wherein the step of chemically reducing includes the step of chemically reducing the precursor compound mixture by fused salt electrolysis.

8. The method of claim 1, wherein the step of chemically reducing includes the step of chemically reducing the precursor compound mixture by vapor-phase reduction.

9. The method of claim 1, wherein the step of chemically reducing includes the step of chemically reducing the precursor compound mixture by contact with a liquid selected from the group consisting of a liquid alkali metal and a liquid alkaline earth metal.

10. A method for preparing an article made of aluminum base metal alloyed with an alloying element, comprising the steps of providing a chemically reducible nonmetallic base-metal precursor compound of the aluminum base metal;

providing a chemically reducible nonmetallic alloying-element precursor compound of an alloying element that is thermophysically melt incompatible with the aluminum base metal; thereafter mixing the base-metal precursor compound and the alloying-element precursor compound to form a precursor compound mixture; thereafter chemically reducing the precursor compound mixture to produce a metallic alloy, without melting the metallic alloy; and thereafter consolidating the metallic alloy to produce a consolidated metallic article, without melting the metallic alloy and without melting the consolidated metallic article.

11. The method of claim 10, wherein the step of providing the chemically reducible nonmetallic alloying-element precursor compound of the alloying element includes the step of providing the chemically reducible nonmetallic alloying-element precursor compound of the alloying element, wherein the alloying element exhibits a miscibility gap with an aluminum base metal in the liquid phase.

12. The method of claim 10, wherein the step of providing the chemically reducible nonmetallic alloying-element precursor compound of the alloying element includes the step of providing the chemically reducible nonmetallic alloying-element precursor compound of the alloying element, wherein the alloying element forms a phase when melted with an aluminum base metal in the liquid phase having a higher melting point than the aluminum base metal.

13. The method of claim 10, wherein the step of providing chemically reducible nonmetallic alloying-element precursor compound of the alloying element includes the step of providing the chemically reducible nonmetallic alloying-element precursor compound of the alloying element, wherein the alloying element exhibits a eutectic, a eutectoid, a peritectic, or a peritectoid with the aluminum base metal.

14. The method of claim 10, wherein the step of providing the chemically reducible nonmetallic alloying-element precursor compound of the alloying element includes the step of providing the chemically reducible nonmetallic alloying-element precursor compound of the alloying element, wherein the alloying element is nitrogen, oxygen or phosphorus.

15. The method of claim 10, wherein the step of providing the chemically reducible nonmetallic alloying-element precursor compound of the alloying element includes the step of providing the chemically reducible nonmetallic alloying-element precursor compound of the alloying element, wherein the alloying element has a vapor pressure of greater than about 10 times a vapor pressure of the aluminum base metal in a melt of the aluminum base metal, both measured at a melt temperature.

16. The method of claim 10, wherein the step of providing the chemically reducible nonmetallic alloying-element precursor compound of the alloying element includes the step of providing the chemically reducible nonmetallic alloying-element precursor compound of the alloying element, wherein the alloying element has a melting point different from that of the aluminum base metal by more than about 200° C.

17. The method of claim 10, wherein the step of providing the chemically reducible nonmetallic alloying-element precursor compound of the alloying element includes the step of providing the chemically reducible nonmetallic alloying-element precursor compound of the alloying element, wherein the alloying element has a density difference with the aluminum base metal of greater than about 0.5 gram per cubic centimeter.

18. The method of claim 10, wherein the step of providing the chemically reducible nonmetallic alloying-element precursor compound of the alloying element includes the step of providing the chemically reducible nonmetallic alloying-element precursor compound of the alloying element, wherein the alloying element chemically reacts with the aluminum base metal by a liquid-phase reaction to form a chemical phase including the aluminum base metal and the alloying element.

19. The method of claim 10, including an additional step, after the step of mixing and before the step of chemically reducing, of compacting the precursor compound mixture.

20. The method of claim 10, wherein the step of chemically reducing includes the step of chemically reducing the precursor compound mixture to produce the metallic alloy in the form of a sponge.

21. The method of claim 10, including an additional step, prior to the step of mixing, of providing a chemically reducible nonmetallic alloying-element compatible precursor compound of an alloying element that is not thermophysically melt incompatible with the aluminum base metal, and wherein the step of mixing includes the step of mixing the base-metal precursor compound, the alloying-element precursor compound, and the alloying-element compatible precursor compound to form a precursor compound mixture.

22. The method of claim 10, including an additional step, after the step providing a chemically reducible nonmetallic alloying-element precursor compound of introducing an other additive constituent.

* * * * *